United States Patent [19]

Bianchi

[11] 4,441,441

[45] Apr. 10, 1984

[54] NEEDLE BAR DRIVE IN SEWING MACHINES

[75] Inventor: Nereo Bianchi, Pavia, Italy

[73] Assignee: NECCHI, Pavia, Italy

[21] Appl. No.: 382,554

[22] Filed: May 27, 1982

[30] Foreign Application Priority Data

Jun. 10, 1981 [IT] Italy ..... 42912 A/81

[51] Int. Cl.[3] ..... D05B 55/14

[52] U.S. Cl. ..... 112/221; 112/158 R

[58] Field of Search ..... 112/221, 158 R; 74/594

[56] References Cited

U.S. PATENT DOCUMENTS 769,039 8/1904 Abercrombie ..... 112/221

2,883,952 4/1959 Meloy, Jr. et al. ..... 112/221

4,000,706 1/1977 Kreissl et al. ..... 112/221

*Primary Examiner*—Werner H. Schroeder

*Assistant Examiner*—Andrew M. Falik

*Attorney, Agent, or Firm*—Stevens, Davis, Miller & Mosher

[57] ABSTRACT

Needle bar drive in a sewing machine comprising a crank driven by a connecting rod provided on the main shaft for transmitting reciprocating motion to the needle bar and by a rod connected to the needle bar gate and driven by a linear motor in order to impart to the needle bar transverse movements relative to the sewing direction. A joint type connection between the connecting rod and the needle bar is provided in order to allow a smooth rational operation to the assembly.

1 Claim, 4 Drawing Figures

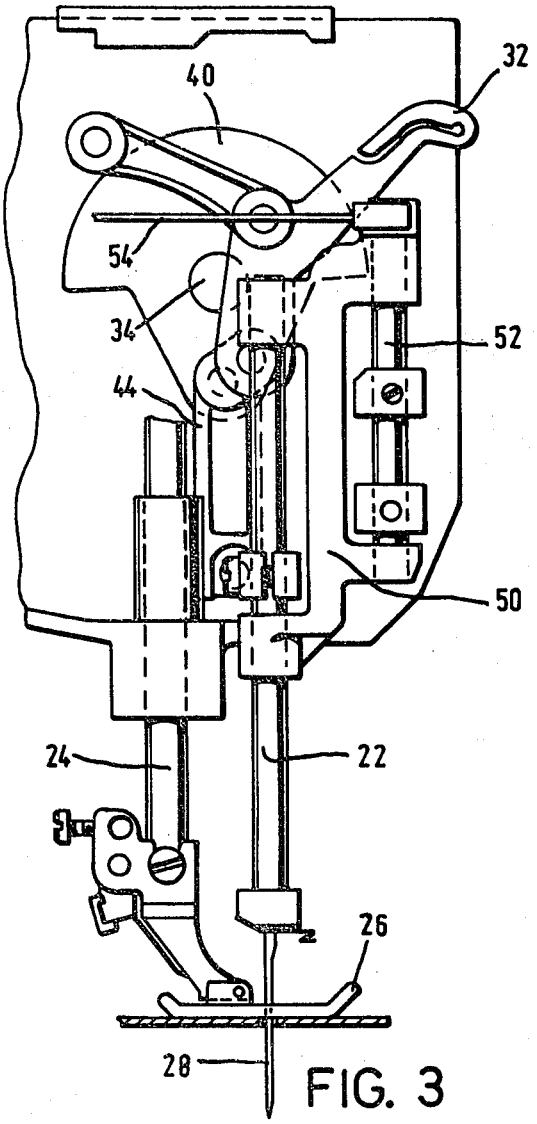
FIG. 3
FIG. 4
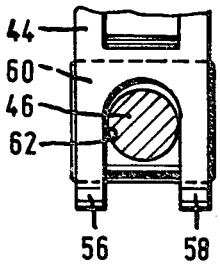

NEEDLE BAR DRIVE IN SEWING MACHINES

BACKGROUND OF THE INVENTION

The present invention relates to a connection between a needle bar and connecting rod in a needle bar drive in zig-zag sewing machines comprising the crank mounted at the end of the main shaft of the sewing machine, the connecting rod connected at one end to the crank and at the other end to a pin of a needle bar block and a control rod suitable to impart to the needle bar transverse movements in the fabric feed direction during which the needle bar longitudinal movements remain parallel.

In the drive when the needle bar moves as described above for zig-zag sewing, the needle bar block pin slides inside the head of the connecting rod. Either for parallelism errors between the members of the kinematic chain driving the needle bar or for the use of particular devices providing the transverse displacements of the needle bar for obtaining patterns or zig-zag stitches, jamming of the block pin may occur inside the big end of the connecting rod.

In fact, in sewing machines where the transverse movements of the needle bar are derived from a gradually variable profile of a cam, the relative slipping between the block pin and the big end of the connecting rod lasts for a considerable period of the cycle and is accompanied by a relative rolling between the two members of the coupling. On the contrary, in the electronically operated sewing machines where the needle bar transverse displacements are controlled by linear or stepping motors, actuated by current pulses, having a very short response time, the relative slipping between the block pin and the big end of the connecting rod may take place at a very high speed without the relative rolling between the members.

Jamming phenomenons, caused by unavoidable parallelism errors and by the load of an inertial kind on the coupling, reveal harmful repeating of the working cycles. An object of the present invention is to eliminate this possible inconvenience.

The technical problem to be solved in order to obtain the object mentioned was to create a particular coupling suitable to eliminate the described drawback.

The solution of the technical problem is characterized by the fact that the connection between the needle bar and the connecting rod is provided by a roller-shaped bush rotatably mounted in a seat in the fork-shaped lower portion of the connecting rod, the pin connecting the bush and the connecting rod sliding inside a bore in the bush, the bore in the bush having its axis perpendicular to the bush roller axis.

Further characteristics and advantages will become apparent from the following description of a preferred embodiment of the invention and from the annexed drawings in which:

FIG. 3 shows a side view of the driving assembly of FIG. 2; and

FIG. 4 shows a sectional view of a part of the drive assembly of FIGS. 2 and 3.

Figure 1:
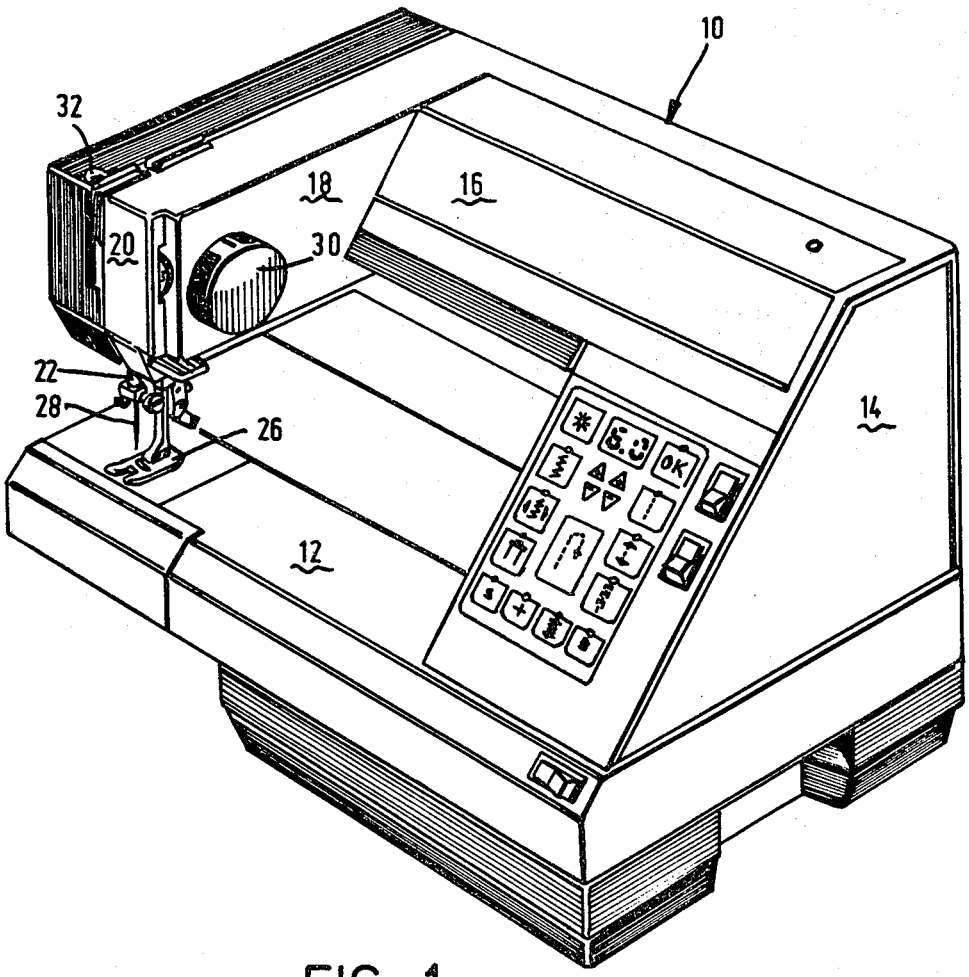
FIG. 1 shows a perspective view of the sewing machine with the drive assembly of the invention.

With reference to FIG. 1, numeral 10 indicates a sewing machine comprising a bed 12, a standard 14, a first portion of an upper arm 16 running longitudinally relative to the sewing machine over bed 12, a second portion 18 of the arm running perpendicularly to the first portion extending from the rear of the sewing machine towards the front thereof and a head 20 in which needle bar 22, presser bar 24 (FIG. 3) and the driving and adjusting instrumentalities therefor are contained.

In FIG. 1, there are also shown the presser foot 26, the needle 28, the handwheel 30 and the thread take-up lever 32. Inside head 20 a shaft 34 (FIG. 2) is mounted to freely rotate by means of a toothed belt 36 wound on a pulley 38 provided on the counterbalance 40 fixed on the shaft 34. Shaft 34 is supported by a bush 35 and is driven by the main shaft, supported by arm 16 not shown in the drawings.

Also on the counterbalance 40 a crank 42 is provided connected at one end to an end of the connecting rod 44 which in turn is connected at its opposite end to a pin 46 fixed to a block 48 connected to the needle bar 22. According to the present invention, the connection between the connecting rod 44 and pin 46 rigid with respect to the needle bar 22 is shown in FIGS. 2 and 4 and described in detail hereinafter.

In the needle bar driving system used to impart the transverse displacements thereto in order to obtain the zig-zag sewing, the needle bar 22 is mounted on a needle bar gate 50 pivoted on member 52 fixed to the head 20 (FIG. 3). In its upper part, the gate 50 is connected to a control rod 54 so that the axial displacements imparted thereto by a control member, such as a cam stack or an electric actuator of the type recently used in the electronically controlled sewing machine, translate into rotations of the same gate around the member 52. So the needle bar 22, free to make reciprocal longitudinal movements relative to the gate 50, but integral therewith in the transverse movements, makes transverse displacements of a proportional width relative to the reciprocations of the control rod 54. During the displacements (FIG. 2) the pin 46 must slide back and forth inside the support in the directions shown by arrow A.

In order to avoid jamming between the coupled members, particularly when the drive control is imparted by an electromechanical actuator and requires a very short time, unlike with the gradual control type imparted by a standard cam driving system, a special type of joint is used.

Figure 2:
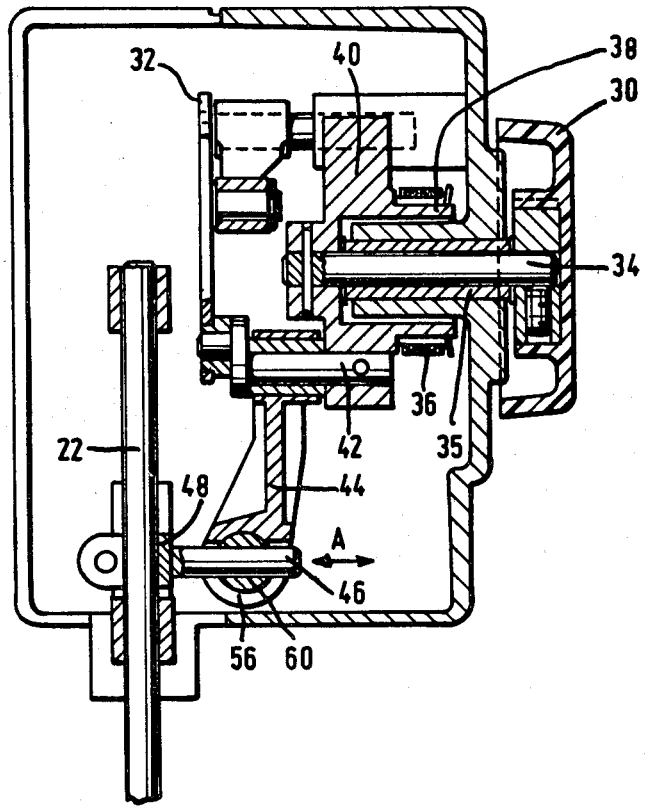
FIG. 2 shows a sectional view of the drive assembly.

With reference to FIGS. 2 and 4, the connecting rod 44 has a fork-shaped end with two legs 56 and 58 having a circular bore. Inside this bore a roller bush 60 is arranged, free to rotate, and provided with a bore 62 having its axis perpendicular to the bore into which the roller bush is positioned. The pin 46 acting as a link between the connecting rod and the needle bar, slides inside the bore 62.

Due to the relatively free rotation between the members jamming in the coupling between the connecting rod 44 and pin 46 is eliminated.

What is claimed is:

1. Needle bar drive in sewing machines having a front and back in which the work is fed from front to back comprising a crank provided at the end of a main shaft of the sewing machine; a needle bar block having a pin extending therefrom; a connecting rod connected at one end to the crank and at the other end to the pin of the needle bar block, said connecting rod at the other end having a fork-shaped lower portion with a bore therethrough; a control rod provided to impart transverse movement to a needle bar relative to the work feed direction; and a connection between the needle bar and the connecting rod, said connection being a roller shaped bush rotatably mounted in the bore in the fork shaped lower portion of the connecting rod, said bush having a bore therethrough with its axis perpendicular to the axis of the bore through the connecting rod, said pin sliding inside the bore of said bush to connect the bush and the connecting rod.

* * * * *